US008323865B2

(12) United States Patent
Chen et al.

(10) Patent No.: US 8,323,865 B2
(45) Date of Patent: Dec. 4, 2012

(54) TONER PROCESSES

(75) Inventors: Allan K. Chen, Oakville (CA); Guerino G. Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 597 days.

(21) Appl. No.: 12/535,177

(22) Filed: Aug. 4, 2009

(65) Prior Publication Data

US 2011/0033793 A1 Feb. 10, 2011

(51) Int. Cl.
*G03G 9/093* (2006.01)

(52) U.S. Cl. ..... 430/110.2; 430/109.4

(58) Field of Classification Search ..... 430/109.4, 430/110.2

See application file for complete search history.

(56) References Cited

U.S. PATENT DOCUMENTS

| | | | | |
|---|---|---|---|---|
| 3,590,000 | A | | 6/1971 | Palermiti et al. |
| 3,655,374 | A | | 4/1972 | Palermiti et al. |
| 3,720,617 | A | | 3/1973 | Chatterji et al. |
| 3,847,604 | A | | 11/1974 | Hagenbach et al. |
| 3,944,493 | A | | 3/1976 | Jadwin et al. |
| 3,983,045 | A | | 9/1976 | Jugle et al. |
| 4,007,293 | A | | 2/1977 | Mincer et al. |
| 4,079,014 | A | | 3/1978 | Burness et al. |
| 4,295,990 | A | | 10/1981 | Verbeek et al. |
| 4,394,430 | A | | 7/1983 | Jadwin et al. |
| 4,560,635 | A | | 12/1985 | Hoffend et al. |
| 4,935,326 | A | | 6/1990 | Creatura et al. |
| 4,937,166 | A | | 6/1990 | Creatura et al. |
| 5,236,629 | A | | 8/1993 | Mahabadi et al. |
| 5,278,020 | A | | 1/1994 | Grushkin et al. |
| 5,290,654 | A | | 3/1994 | Sacripante et al. |
| 5,302,486 | A | | 4/1994 | Patel et al. |
| 5,308,734 | A | | 5/1994 | Sacripante et al. |
| 5,330,874 | A | | 7/1994 | Mahabadi et al. |
| 5,344,738 | A | | 9/1994 | Kmiecik-Lawrynowicz et al. |
| 5,346,797 | A | | 9/1994 | Kmiecik-Lawrynowicz et al. |
| 5,348,832 | A | * | 9/1994 | Sacripante et al. ..... 430/109.4 |
| 5,364,729 | A | | 11/1994 | Kmiecik-Lawrynowicz et al. |
| 5,366,841 | A | | 11/1994 | Patel et al. |
| 5,370,963 | A | | 12/1994 | Patel et al. |
| 5,403,693 | A | | 4/1995 | Patel et al. |
| 5,405,728 | A | | 4/1995 | Hopper et al. |
| 5,418,108 | A | | 5/1995 | Kmiecik-Lawrynowicz et al. |
| 5,496,676 | A | | 3/1996 | Croucher et al. |
| 5,501,935 | A | | 3/1996 | Patel et al. |
| 5,527,658 | A | | 6/1996 | Hopper et al. |
| 5,585,215 | A | | 12/1996 | Ong et al. |
| 5,650,255 | A | | 7/1997 | Ng et al. |
| 5,650,256 | A | | 7/1997 | Veregin et al. |
| 5,723,253 | A | | 3/1998 | Higashino et al. |
| 5,744,520 | A | | 4/1998 | Kmiecik-Lawrynowicz et al. |
| 5,747,215 | A | | 5/1998 | Ong et al. |
| 5,763,133 | A | | 6/1998 | Ong et al. |
| 5,766,818 | A | | 6/1998 | Smith et al. |
| 5,804,349 | A | | 9/1998 | Ong et al. |
| 5,827,633 | A | | 10/1998 | Ong et al. |
| 5,840,462 | A | | 11/1998 | Foucher et al. |
| 5,853,944 | A | | 12/1998 | Foucher et al. |
| 5,863,698 | A | | 1/1999 | Patel et al. |
| 5,869,215 | A | | 2/1999 | Ong et al. |
| 5,902,710 | A | | 5/1999 | Ong et al. |
| 5,910,387 | A | | 6/1999 | Mychajlowskij et al. |
| 5,916,725 | A | | 6/1999 | Patel et al. |
| 5,919,595 | A | | 7/1999 | Mychajlowskij et al. |
| 5,925,488 | A | | 7/1999 | Patel et al. |
| 5,977,210 | A | | 11/1999 | Patel et al. |
| 6,004,714 | A | | 12/1999 | Ciccarelli et al. |
| 6,190,815 | B1 | | 2/2001 | Ciccarelli et al. |
| 6,593,049 | B1 | | 7/2003 | Veregin et al. |
| 6,730,450 | B1 | | 5/2004 | Moffat et al. |
| 6,743,559 | B2 | | 6/2004 | Combes et al. |
| 6,756,176 | B2 | | 6/2004 | Stegamat et al. |
| 6,780,500 | B2 | | 8/2004 | Dumouchel |
| 6,830,860 | B2 | | 12/2004 | Sacripante et al. |
| 7,029,817 | B2 | | 4/2006 | Robinson et al. |
| 7,981,584 | B2 | * | 7/2011 | Zhou et al. ..... 430/110.2 |
| 8,084,180 | B2 | * | 12/2011 | Zhou et al. ..... 430/110.2 |
| 2001/0018157 | A1 | * | 8/2001 | Aoki et al. ..... 430/109.4 |
| 2005/0095523 | A1 | | 5/2005 | Shimokusa et al. |
| 2006/0057486 | A1 | | 3/2006 | Moriyama et al. |
| 2006/0222991 | A1 | | 10/2006 | Sacripante et al. |
| 2006/0292477 | A1 | * | 12/2006 | Daimon et al. ..... 430/109.4 |
| 2009/0047593 | A1 | * | 2/2009 | Vanbesien et al. ..... 430/110.2 |

FOREIGN PATENT DOCUMENTS

| | | |
|---|---|---|
| EP | 1 930 781 | 6/2008 |

OTHER PUBLICATIONS

EP Search Report for EP 10 17 0939 dated Nov. 15, 2010.

* cited by examiner

*Primary Examiner* — Christopher Rodee
(74) *Attorney, Agent, or Firm* — Eugene O. Palazzo

(57) ABSTRACT

Toners are provided which may be suitable for use in cold fusing pressure apparatus. The toners include low molecular weight amorphous resins having low softening points and low molecular weights, compared with resins utilized in conventional emulsion aggregation toners for low melt fusing applications.

9 Claims, No Drawings

TONER PROCESSES

BACKGROUND

This disclosure is generally directed to toner processes, and more specifically, emulsion aggregation and coalescence processes, as well as toner compositions formed by such processes and development processes using such toners for use with Xerographic copying or printing engine comprised of a cold pressure fixing device.

Emulsion aggregation/coalescing processes for the preparation of toners are illustrated in a number of patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817.

In a number of electrophotographic engines and processes, toner images may be applied to substrates. The toners may then be fused to the substrate by heating the toner with a contact fuser or a non-contact fuser, wherein the transferred heat melts the toner mixture onto the substrate. These toner resins may be designed with viscoelastic properties such as to not offset during fusing when they become molten within the fuser rolls.

Another method for fusing toners to substrates includes cold fusing, sometimes referred to herein, in embodiments, as cold pressure fusing or cold fixing. While such systems may have lower energy requirements, they often are utilized with systems operating at a lower speed and thus produce prints at a lower volume and/or rate at volume 200 prints per minute.

Improved toners that are fixed to paper with cold fusing thus remain desirable.

SUMMARY

The present disclosure provides EA toner compositions and processes for producing toners suitable for cold pressure fusing applications, as well as apparatus which may utilize such toners.

In embodiments, a toner of the present disclosure may include at least one low molecular weight amorphous resin having a molecular weight of from about 500 to about 10000 daltons, at least one crystalline resin, at least one wax, and an optional colorant, wherein the at least one low molecular weight resin possesses a softening point of from about 90° C. to about 105° C. and a glass transition temperature of from about 50° C. to about 60° C.

In other embodiments, a toner of the present disclosure may include at least one low molecular weight amorphous polyester resin having a molecular weight of from about 500 to about 10,000 daltons, at least one crystalline polyester resin, at least one wax such as polyethylene, polypropylene, and polybutene, and combinations thereof and an optional colorant, wherein the at least one low molecular weight resin possesses a softening point of from about 90° C. to about 105° C., and a glass transition temperature of from about 50° C. to about 60° C.

In embodiments, the present disclosure provides an electrophotographic machine including a developer unit including toner for developing a latent image, wherein said toner includes an emulsion aggregation toner including at least one low molecular weight amorphous polyester resin having a molecular weight of from about 500 to about 10,000 daltons, a softening point of from about 90° C. to about 105° C., and a glass transition temperature of from about 50° C. to about 60° C., in combination with at least one crystalline polyester resin, at least one wax, and an optional colorant, and a fuser member for fusing said toner to a flexible substrate via application of pressure of from about 1000 psi to about 10,000 psi.

DETAILED DESCRIPTION

In accordance with the present disclosure, low melt EA toners are provided which include a low molecular weight resin, optionally a high molecular weight resin, a crystalline resin, a pigment, and a wax. The toners of the present disclosure possess good fixing properties, in embodiments, utilizing a cold pressure fusing apparatus. The use of cold pressure fusing may lower the energy costs associated with the use of the toner.

Resin

Toners of the present disclosure may include any latex resin suitable for use in forming a toner. Such resins, in turn, may be made of any suitable monomer. Suitable monomers useful in forming the resin include, but are not limited to, acrylonitriles, diols, diacids, diamines, diesters, diisocyanates, combinations thereof, and the like. Any monomer employed may be selected depending upon the particular polymer to be utilized.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid or diester in the presence of an optional catalyst. For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 500 to about 50,000, in embodiments from about 500 to about 20,000, and a weight average molecular weight (Mw) of, for example, from about 1000 to about 20,000 as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or anhydrides or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethyifumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include amorphous polyester resins. Exemplary amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly(propoxylated bisphenol A co-fumarate)-terpoly(propoxylated bisphenol A co-terephthalate)-terpoly-(propoxylated bisphenol A co-dodecylsuccinate), and combinations thereof. In embodiments, the amorphous resin utilized in the core may be linear.

In embodiments, a suitable amorphous polyester resin may be a copoly(propoxylated bisphenol A co-fumarate)-copoly(propoxylated bisphenol A co-terephthalate) resin having the following formula (I):

(I)

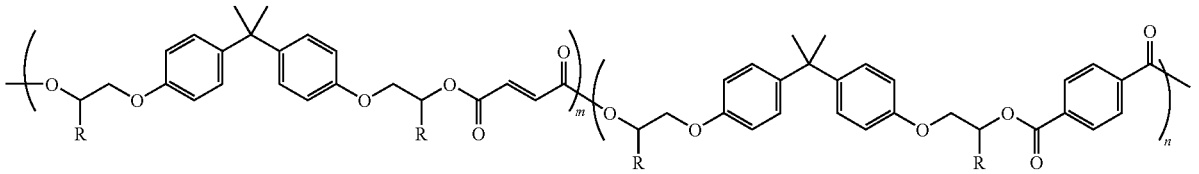

wherein R may be hydrogen or a methyl group, and m and n represent random units of the copolymer and m may be from about 2 to 10, and n may be from about 2 to 10. Other suitable resins include one of the terpolyesters set forth below in Formula (II)

(II)

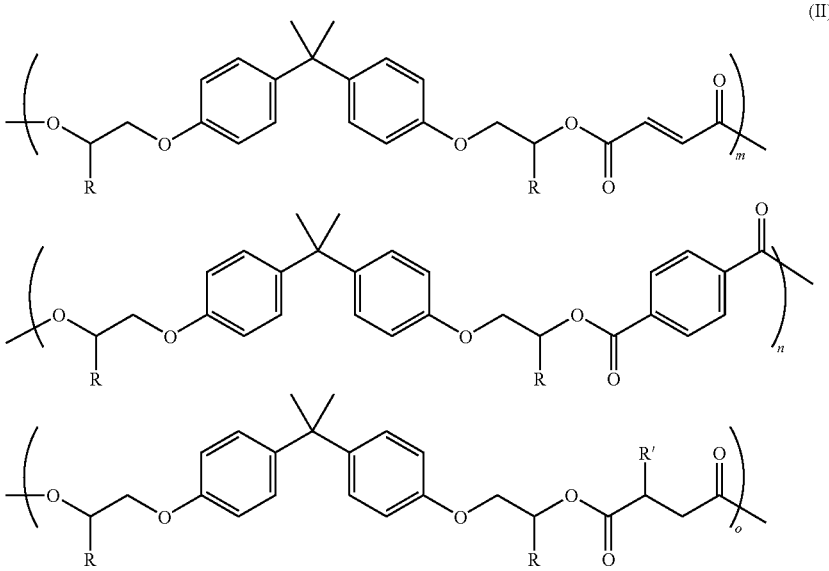

wherein R is hydrogen or a methyl group, R' is an alkyl group from about 2 to about 20 carbon atoms, and m, n and o represent random units of the copolymer and m may be from about 2 to 10, n may be from about 2 to 10, and o from about 2 to about 10.

An example of a linear copoly(propoxylated bisphenol A co-fumarate)—copoly(propoxylated bisphenol A co-terephthalate) which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

In embodiments, a suitable amorphous resin utilized in a toner of the present disclosure may be a low molecular weight amorphous resin, sometimes referred to, in embodiments, as an oligomer, having a weight average molecular weight (Mw) of from about 500 daltons to about 10,000 daltons, in embodiments from about 1000 daltons to about 5000 daltons, in other embodiments from about 1500 daltons to about 4000 daltons.

The low molecular weight amorphous resin may possess a glass transition temperature of from about 50° C. to about 60° C., in embodiments from about 55° C. to about 58° C.

The low molecular weight amorphous resin may possess a softening point of from about 90° C. to about 105° C., in embodiments from about 95° C. to about 100° C.

An amorphous resin having a low molecular weight (sometimes referred to as an oligomer) utilized in forming a toner of the present disclosure may be contrasted with a high molecular weight amorphous resin having a weight average molecular weight (Mw) of from about 5,000 daltons to about 100,000 daltons, in embodiments from about 10,000 daltons to about 25,000 daltons. High molecular weight amorphous resins may possess a glass transition temperature of from about 50° C. to about 65° C., in embodiments from about 55° C. to about 58° C. and a softening point of from about 105° C. to about 150° C., in embodiments from about 110° C. to about 130° C.

In embodiments, a low molecular weight amorphous resin, having a low softening point, may be suitable for use in forming toners, especially for use in developers including a cold pressure fusing apparatus.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(III)

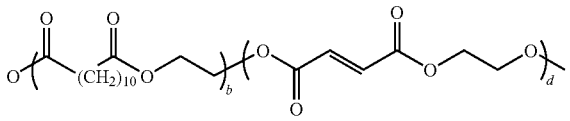

wherein b is from about 5 to about 40 and d is from about 7 to about 20.

In embodiments, a suitable crystalline resin utilized in a toner of the present disclosure may have a molecular weight of from about 500 to about 3,000, in embodiments from about 1000 to about 2,000.

One, two, or more resins may be used in forming a toner. In embodiments where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

As noted above, in embodiments, the resin may be formed by emulsion aggregation methods. Utilizing such methods, the resin may be present in a resin emulsion, which may then be combined with other components and additives to form a toner of the present disclosure.

The polymer resin may be present in an amount of from about 65 to about 95 percent by weight, or preferably from about 75 to about 85 percent by weight of the toner particles (that is, toner particles exclusive of external additives) on a solids basis. The ratio of crystalline resin to amorphous resin can be in the range from about 1:99 to about 30:70, such as from about 5:95 to about 25:75, in some embodiments from about 5:95 to about 15:95. Other components such as waxes, may be present in an amount from about 5 to about 25% by weight.

Toner

The resins described above, in embodiments a combination of polyester resins, for example a low molecular weight amorphous resin and a crystalline resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites M08029™, M08060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASE), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

In addition to the polymer binder resin and photoinitiator, the toners of the present disclosure also optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Where utilized, the wax may be combined with the resin in forming toner particles. When included, the wax may be present in an amount of, for example, from about 1 weight percent to about 25 weight percent of the toner particles, in embodiments from about 3 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resin(s). The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1 parts per hundred (pph) to about 1 pph, in embodiments from about 0.25 pph to about 0.75 pph, in some embodiments about 0.5 pph. This provides a sufficient amount of agent for aggregation.

The gloss of a toner may be influenced by the amount of retained metal ion, such as $Al^{3+}$, in the particle. The amount of retained metal ion may be further adjusted by the addition of EDTA. In embodiments, the amount of retained crosslinker, for example $Al^{3+}$, in toner particles of the present disclosure may be from about 0.1 pph to about 1 pph, in embodiments from about 0.25 pph to about 0.8 pph, in embodiments about 0.5 pph.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

In embodiments, the aggregate particles may be of a size of less than about 3 microns, in embodiments from about 2 microns to about 3 microns, in embodiments from about 2.5 microns to about 2.9 microns.

Shell resin

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration. In some embodiments, a low molecular weight amorphous resin may be utilized to form a shell over the formed aggregates.

The shell resin may be present in an amount of from about 10 percent to about 32 percent by weight of the toner particles, in embodiments from about 24 percent to about 30 percent by weight of the toner particles.

Once the desired final size of the toner particles is achieved, the pH of the mixture may be adjusted with a base to a value of from about 6 to about 10, and in embodiments from about 6.2 to about 7. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat.

Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −35 μC/g , and a final toner charging after surface additive blending of from −10 μC/g to about −45 μC/g.

Utilizing the methods of the present disclosure, desirable gloss levels may be obtained. Thus, for example, the gloss level of a toner of the present disclosure may have a gloss as measured by Gardner Gloss Units (ggu) of from about 20 ggu to about 100 ggu, in embodiments from about 50 ggu to about 95 ggu, in embodiments from about 60 ggu to about 90 ggu.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 2.5 to about 20 microns, in embodiments from about 2.75 to about 18 microns, in other embodiments from about 5 to about 15 microns.

(2) Number Average Geometric Standard Deviation (GSDn) and/or Volume Average Geometric Standard Deviation (GSDv) of from about 1.18 to about 1.30, in embodiments from about 1.21 to about 1.24.

(3) Circularity of from about 0.9 to about 1 (measured with, for example, a Sysmex FPIA 2100 analyzer), in embodiments form about 0.95 to about 0.985, in other embodiments from about 0.96 to about 0.98.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethyinethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser member. The fusing member can be of any desired or suitable configuration, such as a drum or roller, a belt or web, a flat surface or platen, or the like. The fusing member can be applied to the image by any desired or suitable method, such as by passing the final recording substrate through a nip formed by the fusing member and a back member, which can be of any desired or effective configuration, such as a drum or roller, a belt or web, a flat surface or platen, or the like. In embodiments, a fuser roll can be used. Fuser roll members are contact fusing devices that are within the purview of those skilled in the art, in which pressure from the roll, optionally with the application of heat, may be used to fuse the toner to the image-receiving medium. Optionally, a layer of a liquid such as a fuser oil can be applied to the fuser member prior to fusing.

In embodiments, the toner image can be fused by cold pressure fusing, i.e., without the application of heat. Fusing can be effected at any desired or effective pressure, in embodiments from about 1000 pounds per square inch (psi) to about 10,000 pounds per square inch, in embodiments from about 1,500 pounds per square inch to about 5,000 pounds per square inch. One advantage with cold pressure fusing is that it requires low power, and unlike hot roll processes, no standby power. Thus, toners of the present disclosure may be utilized in systems that are more environmentally friendly, having lower energy requirements. Moreover, as heat is not applied to the toners, the toners do not become molten and thus do not offset during fusing.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

A polyester resin emulsion was prepared derived from terephthalic acid, propoxylated-bisphenol A, and fumaric acid.

A 1 liter Parr reactor equipped with an electric heater, distillation apparatus and agitator was charged with bisphenol A (about 223 grams) propylene carbonate (about 208.4 grams) and potassium carbonate (about 0.5 grams). The mixture was heated with nitrogen purge to about 165° C. for about 5 hours to produce a propoxylated bisphenol A monomer. To this was added terephthalic acid and dibutyl tin oxide, and the mixture was heated to about 240° C. for about 12 hours, after which the contents were cooled to about 185° C. and to this was added fumaric acid (about 60 grams)and hydroquinone (about 0.22 grams). The mixture was heated to about 205° C. for about 4 hours, during which time water was collected as a byproduct through the distillation apparatus. The mixture was then subjected to vacuum (about 0.1 mm-Hg) for a duration of about 3 hours after which the contents were discharged through the bottom drain valve and cooled to room temperature. The resin product was copoly(propoxylated bisphenol A co-fumarate)—copoly(propoxylated bisphenol A co-terephthalate), as described in Formula I above. The glass transition temperature was found to be 53° C., with a softening point of 104° C., a number average molecular weight of 1,400 daltons, and a weight average molecular weight of 2,000 daltons.

About 125 grams of the above resin was measured into a 2 liter beaker containing about 917 grams of ethyl acetate. The mixture was stirred at about 250 revolutions per minute and heated to about 67° C. to dissolve the resin in the ethyl acetate. About 3.05 grams of sodium bicarbonate was measured into a 4 liter Pyrex glass flask reactor containing about 708 grams of deionized water and heated to about 65° C. Homogenization of the heated water solution in the 4 liter glass flask reactor was commenced with an IKA Ultra Turrax T50 homogenizer at about 4,000 revolutions per minute. The heated resin dissolved in ethyl acetate was then slowly poured into the water solution. As the mixture continued to be homogenized, the homogenizer speed was increased to 10,000 revolutions per minute and homogenization was carried out at these conditions for about 30 minutes. At completion of homogenization, the glass flask reactor and its contents were placed in a heating mantle and connected to a distillation device. The mixture was stirred at about 400 revolutions per minute and the temperature of the mixture was increased to about 80° C. at about 1° C. per minute to distill off the ethyl acetate from the mixture. Stirring of the mixture was continued at about 80° C. for about 120 minutes followed by cooling at about 2° C. per minute to room temperature. The product was screened through a 20 micron sieve and the pH was adjusted to 7.0 with the addition of 1.0 normal sodium hydroxide. The resulting polyester resin emulsion included about 22% by weight solids in water as measured gravimetrically, and had a volume average diameter of about 202 nanometers as measured with a HONEYWELL MICROTRAC® UPA150 particle size analyzer.

Example 2

A polyester resin emulsion was prepared derived from terephthalic acid, propoxylated-bisphenol A, 2-dodecyl succinic anhydride, and fumaric acid.

A 1 liter Parr reactor equipped with an electric heater, distillation apparatus, and double turbine agitator and bottom drain valve, was charged with bisphenol A (about 223 grams) propylene carbonate (about 208.4 grams) and potassium carbonate (about 0.5 grams). The mixture was heated with nitrogen purge to about 165° C. for about 5 hours to obtain a propoxylated bisphenol A monomer. To this was added terephthalic acid (about 80.7 grams) and dibutyl tin oxide (about 0.6 grams), and the mixture was heated to about 240° C. for about 12 hours, after which the contents were cooled to about 185° C. and to this was added dodecyl succinic anhydride (about 53.2 grams), fumaric acid (about 40 grams) and hydroquinone (about 0.22 grams). The mixture was heated to about 205° C. for about 4 hours, during which time water was collected as a byproduct through the distillation apparatus. The mixture was then subjected to vacuum (about 0.1 mm-Hg) for a duration of about 3 hours after which the contents were discharged through the bottom drain valve and cooled to room temperature. The resin product was copoly(propoxylated bisphenol A co-fumarate)—copoly(propoxylated bisphenol A co-terephthalate) as described above in Formula I. The glass transition temperature was found to be about 58° C., with a softening point of about 108° C., a number average molecular weight of about 2,100 daltons, and a weight average molecular weight of about 4,400 daltons.

About 125 grams of the above resin was measured into a 2 liter beaker containing about 917 grams of ethyl acetate. The mixture was stirred at about 250 revolutions per minute and heated to about 67° C. to dissolve the resin in the ethyl acetate. About 3.05 grams of sodium bicarbonate was measured into a 4 liter Pyrex glass flask reactor containing about 708 grams of deionized water and heated to about 65° C. Homogenization of the heated water solution in the 4 liter glass flask reactor was commenced with an IKA Ultra Turrax T50 homogenizer at about 4,000 revolutions per minute. The heated dissolved resin in ethyl acetate was then slowly poured into the water solution as the mixture continued to be homogenized; the homogenizer speed was increased to about 10,000 revolutions per minute and homogenization was carried out at these conditions for about 30 minutes. At completion of homogenization, the glass flask reactor and its contents were placed in a heating mantle and connected to a distillation device. The mixture was stirred at about 400 revolutions per minute and the temperature of the mixture was increased to about 80° C. at about 1° C. per minute to distill off the ethyl acetate from the mixture. Stirring of the mixture is continued at about 80° C. for about 120 minutes followed by cooling at about 2° C. per minute to room temperature. The product was screened through a 20 micron sieve and the pH was adjusted to 7.0 with the addition of 1.0 normal sodium hydroxide. The resulting polyester resin emulsion included about 20% by weight solids in water as measured gravimetrically, and had a volume average diameter of about 210 nanometers as measured with a HONEYWELL MICROTRAC® UPA150 particle size analyzer.

Example 3

A crystalline resin was prepared from dodecanedioic acid and nonane diol.

A 1 liter Parr reactor equipped with an electric heater, distillation apparatus and double turbine agitator and bottom drain valve, was charged with dodecanedioic acid (about 345 grams) 1,9-nonanediol (about 235 grams) and butyl tin oxide hydroxide (about 0.5 grams). The mixture was heated to about 185° C. for about 4 hours, during which time water was collected as a byproduct through the distillation apparatus. The mixture was then heated to about 205° C. for about 1 hour and then subjected to vacuum (about 0.1 mm-Hg) for a duration of about 1 hour after which the contents were discharged through the bottom drain valve and cooled to room temperature. The resin product, poly(nonyl-dodecanoate), displayed a melting point of about 70° C., a number average molecular weight of about 1,500 daltons, and a weight average molecular weight of about 3,100 daltons.

About 125 grams of the above resin, was measured into a 2 liter beaker containing about 917 grams of ethyl acetate. The mixture was stirred at about 250 revolutions per minute and heated to about 67° C. to dissolve the resin in the ethyl acetate. About 3.05 grams of sodium bicarbonate was measured into a 4 liter Pyrex glass flask reactor containing about 708 grams of deionized water and heated to about 65° C. Homogenization of the heated water solution in the 4 liter glass flask reactor was commenced with an IKA Ultra Turrax T50 homogenizer at about 4,000 revolutions per minute. The heated dissolved resin in ethyl acetate was then slowly poured into the water solution. As the mixture continued to be homogenized, the homogenizer speed was increased to about 10,000 revolutions per minute and homogenization was carried out at these conditions for about 30 minutes. At completion of homogenization, the glass flask reactor and its contents were placed in a heating mantle and connected to a distillation device. The mixture was stirred at about 400 revolutions per minute and the temperature of the mixture was increased to 80° C. at about 1° C. per minute to distill off the ethyl acetate from the mixture. Stirring of the mixture is continued at 80° C. for about 120 minutes followed by cooling at about 2° C. per minute to room temperature. The product was screened through a 20 micron sieve and the pH was adjusted to about 7.0 with the addition of about 1.0 normal sodium hydroxide. The resulting polyester resin emulsion included about 18% by weight solids in water as measured gravimetrically, and had a volume average diameter of about 220 nanometers as measured with a HONEYWELL MICROTRAC® UPA150 particle size analyzer.

Example 4

A cyan polyester toner was prepared having particles of from about 5.4 microns to about 6.2 microns in size. The toner was prepared as follows.

About 566.5 grams of deionized water (DIW) was combined with about 173 grams of a low molecular weight amphorous latex of the Example 1, about 34 grams of a crystalline polyester latex of Example 3, about 3.67 grams of a DOWFAX anionic surfactant, about 52.9 grams of Pigment Blue 15:3 cyan pigment, and about 46.2 grams of an aqueous dispersion including a polyethylene wax available from IGI Wax, having a particle size of about 220 nm and a solids content of about 20% solids in water. The slurry mixture was pH adjusted to about 4 with diluted nitric acid. The toner slurry was then homogenized using a portable Turrex homogenizer probe at a mixing speed of from about 4000 to about 6000 revolutions per minute (rpm) for about 10 minutes. About 0.2 ppH of Aluminum Sulfate flocculent was also added during the homogenization process The resulting toner slurry was charged into a 2 liter Buchi stainless steel reactor. The reactor was installed with a mechanical agitator and equipped with double impellers. The mixture was agitated at about 450 rpm for about 5 minutes.

The mixture was then heated to about 45° C. as part of the toner aggregation process. Particle growth was monitored during the heat-up, with particle size checked from time to time. When the reactor temperatures reached about 45° C., the toner particle growth was monitored closely until the particle size was about 5 microns.

Then, about 96 grams of a low molecular weight amphorous shell latex was added and heated for about 30 minutes. (The low molecular weight amorphous latex used for the shell was the same as the one described above for use in forming the core.) At this time the particle size was from about 5.8 microns to about 6 microns. The growth of the toner particles was then stopped by adding a small amount of NaOH solution which raised the toner slurry pH to above 7.5, followed by a coalescence process at temperatures above the Tg of the toner resins, about 82° C. The entire process, from raw materials preparation, homogenization, aggregation, to coalescence, took from about 7 hours to about 8 hours. When the desired toner particle size was obtained, the toner slurry was quenched and discharged from the 2 liter reactor.

The resulting cyan polyester toner particles were about 6.15 microns in size, and possessed a GSD of about 1.25, a smooth, potato-type morphology, and a solids content of about 13% by weight. The final solids particles were filtered from the mother liquor, followed by screening and washing at room temperature prior to the drying process.

The resulting toner particles included about 50.6% by weight of the low molecular weight resin, about 6.8% by weight of the crystalline resin, about 5.5% by weight of Pigment Blue 15:3, and about 9% by weight of the wax in the core, with about 28% by weight of the low molecular weight resin as the shell.

The particle size, GSD, and circularity of the above toner was compared with a commercially available toner, Docucolor 7000, available from Xerox corporation.

Particle size, GSD, and circularity of the two toners are summarized below in Table 1.

TABLE 1

| Sample I.D. | Toner Particle Size | GSD | Toner Circularity |
|---|---|---|---|
| Example 4 | 6.15 | 1.25 | 0.97 |
| Xerox 700 Digital Color Press Toner | 5.80 | 1.25 | 0.97 |

Fusing data obtained for the toners of the present disclosure showed satisfactory performance at 3900-5000 psi. Thus, toners of the present disclosure, having comparable GSD and circularity, but larger particle size, may be suitable for cold fusing applications.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An emulsion aggregation toner consisting of: a core of at least one oligomer low molecular weight amorphous resin having a weight average molecular weight of from about 500 to about 10,000 daltons; at least one crystalline resin; at least one wax; and a colorant, wherein the at least one low molecular weight resin possesses a softening point of from about 90° C. to about 105° C. and a glass transition temperature of from about 50° C. to about 60° C. and a shell of said amorphous resin and wherein the at least one crystalline resin consists of a crystalline polyester resin of the formula:

(II)

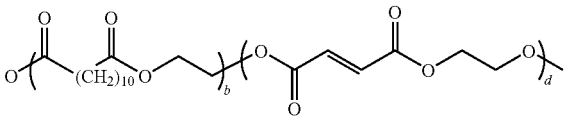

wherein b is from about 5 to about 2000 and d is from about 5 to about 2000.

2. The toner according to claim 1, wherein the at least one low molecular weight amorphous resin consists of a polyester resin.

3. The toner according to claim 1, wherein the at least one low molecular weight amorphous resin consists of an amorphous polyester resin as represented by the following alternative formulas/structures (I)

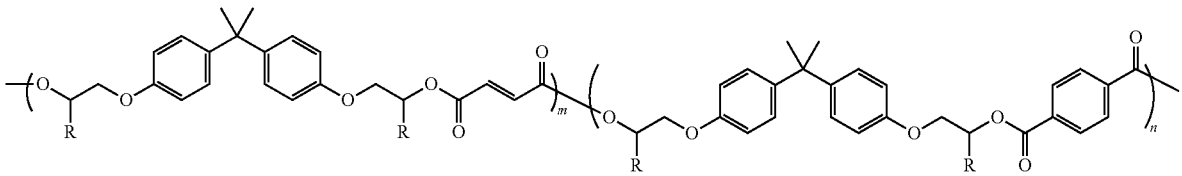

(II)

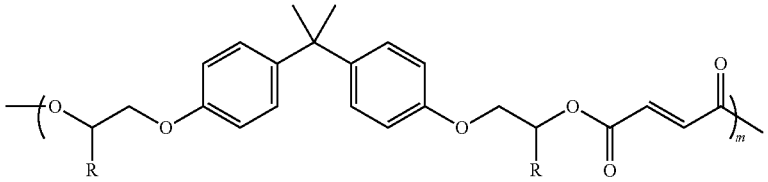

-continued (III)

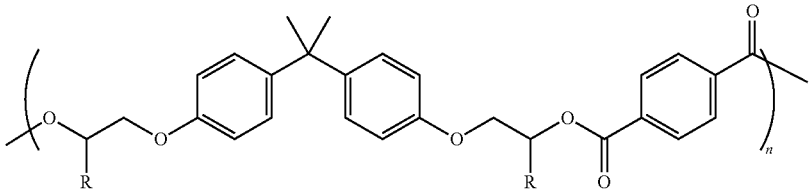

or (IV)

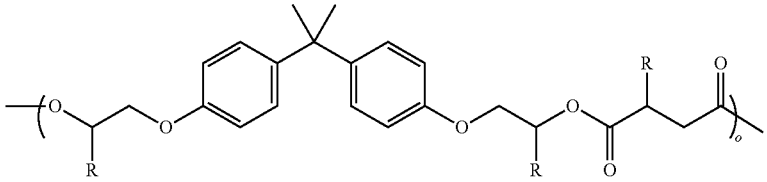

wherein R is a hydrogen or a methyl group, R' is an alkyl group from about 2 to about 20 carbon atoms, and m, n and o represent random units of the copolymer and m is from about 2 to 10, n is from about 2 to 10, and o is from about 2 to about 10.

4. The toner according to claim 1, wherein the wax is selected from the group consisting of polyethylene wax, polypropylene wax, polybutene wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate; diethyleneglycol monostearate, dipropyleneglycol distearate, and combinations thereof.

5. The toner according to claim 1, wherein the wax is present in an amount of from about 3 percent to about 20 percent by weight of the toner.

6. The toner according to claim 1, wherein particles comprising the toner are from about 5 to about 20 microns in size.

7. An emulsion aggregation toner consisting of: a core of an amorphous oligomer polyester resin as represented by the following formulas/structures I, II, III, or IV, and having a weight average molecular weight of from about 500 to about 10,000 daltons; a crystalline polyester resin; a wax selected from the group consisting of polyethylene, polypropylene, and polybutene, and combinations thereof; and a colorant, wherein the oligomer polyester resin possesses a softening point of from about 90° C. to about 105° C. and a glass transition temperature of from about 50° C. to about 60° C. and a shell included on said core consisting of said amorphous oligomer polyester resin of the following formulas/structures I, II, III, or IV having a weight average molecular weight of from about 500 to about 10,000 daltons (I)

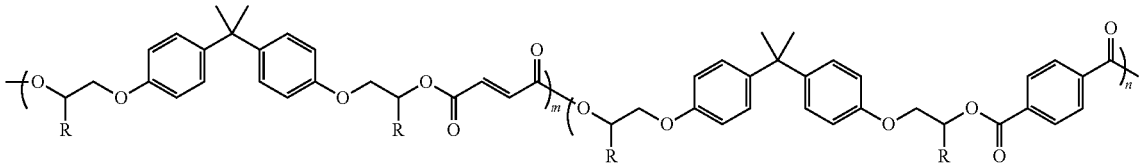

(II)

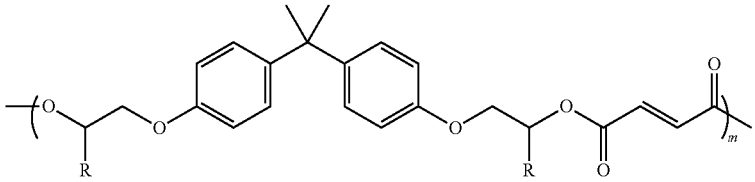

(III)

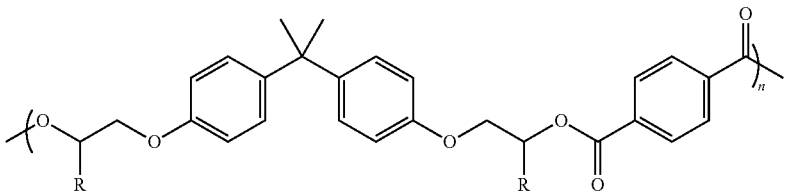

or

-continued (IV)

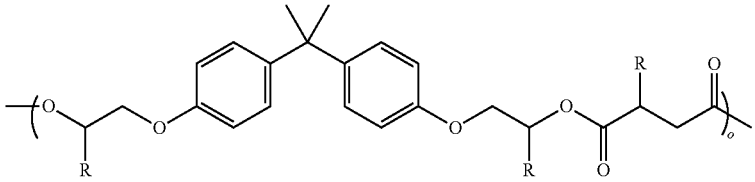

wherein R is a hydrogen or a methyl group, R' is an alkyl group from about 2 to about 20 carbon atoms, and m, n and o represent' random units of the copolymer and m is from about 2 to 10, n is from about 2 to 10, and o is from about 2 to about 10.

8. The toner according to claim 7, wherein said amorphous oligomer core polyester and said amorphous oligomer shell polyester resin each have a weight average molecular weight of from about 1,500 to about 4,000 daltons.

9. The toner according to claim 7, wherein the wax is present in an amount of from about 3 percent to about 20 percent by weight of the toner, and wherein particles of the toner are from about 5 to about 15 microns in size.

* * * * *